US010935234B2

(12) United States Patent
Tsutsumi et al.

(10) Patent No.: US 10,935,234 B2
(45) Date of Patent: Mar. 2, 2021

(54) AUXILIARY BURNER FOR ELECTRIC FURNACE

(71) Applicants: JFE STEEL CORPORATION, Tokyo (JP); CHUGAI RO CO., LTD., Osaka (JP)

(72) Inventors: Koichi Tsutsumi, Tokyo (JP); Yoshihiro Miwa, Tokyo (JP); Sumito Ozawa, Tokyo (JP); Ikuhiro Sumi, Tokyo (JP); Kenichi Tomozawa, Osaka (JP); Takayuki Ito, Osaka (JP)

(73) Assignees: JFE STEEL CORPORATION, Tokyo (JP); CHUGAI RO CO., LTD., Osaka (JP)

( * ) Notice: Subject to any disclaimer, the term of this patent is extended or adjusted under 35 U.S.C. 154(b) by 132 days.

(21) Appl. No.: 16/320,217

(22) PCT Filed: Jul. 24, 2017

(86) PCT No.: PCT/JP2017/026715
§ 371 (c)(1),
(2) Date: Jan. 24, 2019

(87) PCT Pub. No.: WO2018/021248
PCT Pub. Date: Feb. 1, 2018

(65) Prior Publication Data

US 2019/0264914 A1 Aug. 29, 2019

(30) Foreign Application Priority Data

Jul. 26, 2016 (JP) ..... JP2016-146561

(51) Int. Cl.
*F23C 1/12* (2006.01)
*F23D 17/00* (2006.01)
(Continued)

(52) U.S. Cl.
CPC ..... *F23D 17/005* (2013.01); *F23C 1/12* (2013.01); *F23D 14/24* (2013.01); *F23D 17/00* (2013.01);
(Continued)

(58) Field of Classification Search
CPC ..... F23D 17/005
(Continued)

(56) References Cited

U.S. PATENT DOCUMENTS 4,688,496 A * 8/1987 Schreter ..... F23D 1/02 110/264
4,702,180 A * 10/1987 Kiga ..... F23K 3/02 110/106
(Continued)

FOREIGN PATENT DOCUMENTS

EP 2141413 A1 1/2010
JP S5825098 A 2/1983
(Continued)

OTHER PUBLICATIONS

Jul. 30, 2019, Office Action issued by the China National Intellectual Property Administration in the corresponding Chinese Patent Application No. 201780046488.3 with English language concise statement of relevance.
(Continued)

*Primary Examiner* — Avinash A Savani
(74) *Attorney, Agent, or Firm* — Kenja IP Law PC

(57) ABSTRACT

Provided is an auxiliary burner for an electric furnace capable of increasing and homogenizing the heating effect of iron scrap by suitably and efficiently burning solid fuel along with gas fuel. This auxiliary burner 100 for an electric furnace comprises a solid fuel injection tube 1, a gas fuel injection tube 2, and a combustion-supporting gas injection tube 3 in the stated order from the center side, all arranged
(Continued)

coaxially, and is characterized in that: a flow path 30 of the combustion-supporting gas injection tube 3 is provided with a plurality of swirl vanes 4 for swirling the combustion-supporting gas, and a flow path 20 of the gas fuel injection tube 2 is provided with a plurality of swirl vanes 5 for swirling the gas fuel; and the angle $\theta_1$ of the swirl vanes 4 and the $\theta_2$ of the swirl vanes 5 satisfy the relationship $\theta_1<\theta_2$.

10 Claims, 7 Drawing Sheets

(51) Int. Cl.

| | |
|---|---|
| ***F23D 14/24*** | (2006.01) |
| ***F27B 3/08*** | (2006.01) |
| ***F27D 3/16*** | (2006.01) |
| ***F27D 7/02*** | (2006.01) |

(52) U.S. Cl.
CPC ..... *F27B 3/08* (2013.01); *F27D 3/16* (2013.01); *F27D 7/02* (2013.01)

(58) Field of Classification Search
USPC ..... 431/284, 184; 110/264
See application file for complete search history.

(56) References Cited

U.S. PATENT DOCUMENTS

| | | | | |
|---|---|---|---|---|
| 4,928,605 | A * | 5/1990 | Suwa | F23D 1/00 110/261 |
| 5,203,692 | A | 4/1993 | Wexoe | |
| 5,823,764 | A * | 10/1998 | Alberti | F23C 7/006 431/184 |
| 7,289,514 | B2 | 10/2007 | Robotham et al. | |
| 9,017,068 | B2 | 4/2015 | Maekawa et al. | |
| 2012/0129111 | A1 | 5/2012 | Robertson et al. | |
| 2012/0312890 | A1* | 12/2012 | Romig | F23R 3/286 239/5 |
| 2014/0004469 | A1 | 1/2014 | Recourt et al. | |
| 2016/0252246 | A1 | 9/2016 | Arakawa et al. | |

FOREIGN PATENT DOCUMENTS

| | | | |
|---|---|---|---|
| JP | S62225816 | A | 10/1987 |
| JP | S6312923 | B2 | 3/1988 |
| JP | H0712314 | A | 1/1995 |
| JP | H109524 | A | 1/1998 |
| JP | 2003004382 | A | 1/2003 |
| JP | 2004100967 | A | 4/2004 |
| JP | 2005283029 | A | 10/2005 |
| JP | 2012201887 | A | 10/2012 |
| WO | 2009034626 | A1 | 3/2009 |
| WO | 2015136609 | A1 | 9/2015 |

OTHER PUBLICATIONS

Aug. 21, 2018, Notification of Reasons for Refusal issued by the Japan Patent Office in the corresponding Japanese Patent Application No. 2017-559625 with English language Concise Statement of Relevance.

Oct. 3, 2017, International Search Report issued in the International Patent Application No. PCT/JP2017/026715.

Feb. 19, 2019, Notification of Reasons for Refusal issued by the Japan Patent Office in the corresponding Japanese Patent Application No. 2017-559625 with English language concise statement of relevance.

Jun. 25, 2020, Office Action issued by the Korean Intellectual Property Office in the corresponding Korean Patent Application No. 10-2019-7004583 with English language concise statement of relevance.

* cited by examiner

AUXILIARY BURNER FOR ELECTRIC FURNACE

TECHNICAL FIELD

The present disclosure relates to an auxiliary burner attached to an electric furnace for manufacturing molten iron by melting iron scrap.

BACKGROUND

When melting iron scrap using an electric furnace, the iron scrap around the electrode melts quickly; and the iron scrap located away from the electrode, that is, the iron scrap at cold spots melts slowly, resulting in inhomogeneity in melting speed of the iron scrap in the furnace. For this reason, the operating time of the whole furnace has been limited by the melting speed of the iron scrap at the cold spots.

Therefore, in order to solve the inhomogeneity in melting speed of such iron scrap and to melt the iron scrap in the whole furnace in a well-balanced manner, a method of installing auxiliary burners at the the cold spots to preheat, cut, and melt the iron scrap located at the cold spots has been adopted.

As such an auxiliary burner, for example, JPH10-9524A (PTL 1) proposes an auxiliary burner having a triple tube structure that ejects oxygen gas for splattering incombustibles and cutting iron scrap from a center part, ejects fuel from the outer circumference of the oxygen gas, and ejects oxygen gas for combustion from the outer circumference of the fuel. This auxiliary burner is a high-speed pure oxygen auxiliary burner for an electric furnace in which a reduced part is provided on the tip of the oxygen gas ejection tube at the center part so as to increase the speed of the oxygen gas to be ejected from the center part, and swirl vanes are installed in an annular space formed by the fuel ejection tube and the combustion oxygen gas ejection tube so as to swirl the oxygen gas for combustion to be ejected from the outermost circumference.

Additionally, JP2003-004382A (PTL 2) proposes a burner facility for an electric furnace that spreads the directivity of the burner flame over a wide range by eccentrically placing the nozzle tip of the auxiliary burner and rotating the burner.

CITATION LIST

Patent Literature

PTL 1: JPH10-9524A
PTL 2: JP2003-004382A

SUMMARY

Technical Problem

By using the techniques described in PTL 1 and PTL 2, it is possible to efficiently preheat and melt iron scrap using an auxiliary burner. However, in PTL 1 and PTL 2, there is a problem that the fuel to be used is restricted to expensive gas fuel. Examples of inexpensive fuel include solid fuels such as coal. However, it is generally difficult to burn solid fuel faster than gas fuel, and moreover, depending on conditions, an accidental fire may be caused, making it difficult to use solid fuel in an auxiliary burner. Also, if the solid fuel has a large particle size, it cannot burn out in the flame of the burner, such that there is a problem of poor thermal efficiency.

An object of the present disclosure is to provide an auxiliary burner for an electric furnace capable of increasing and homogenizing the heating effect of iron scrap by suitably and efficiently burning solid fuel along with gas fuel.

Solution to Problem

The inventors conducted studies on an auxiliary burner for an electric furnace capable of using solid fuels such as coal. Through the studies, the inventors discovered that, in a multiple tube structure auxiliary burner using gas fuel and solid fuel as fuel, by swirling the combustion-supporting gas injected from the outermost circumference and the gas fuel injected from the inside thereof under specific conditions, the solid fuel can be burned suitably and efficiently along with the gas fuel, and as a result, the scrap heating effect is improved, and the flame temperature of the burner is homogenized.

The inventors further discovered that, in the same multiple tube structure auxiliary burner using gas fuel and solid fuel as fuel, by swirling only the gas fuel injected from between the combustion-supporting gas (injected from the outermost circumference) and the solid fuel (injected from the innermost circumference) under specific conditions, the solid fuel can also be burned suitably and efficiently along with the gas fuel, and as a result, the scrap heating effect is improved, and the flame temperature of the burner is homogenized.

The present disclosure was completed on the basis of such findings, and has the following subject.

[1] An auxiliary burner for an electric furnace for manufacturing molten iron by melting iron scrap, which is attached to the electric furnace and uses a gas fuel and a solid fuel as fuel, comprising:

a solid fuel injection tube defining a first flow path through which the solid fuel passes and configured to inject the solid fuel from a tip of the first flow path;

a gas fuel injection tube arranged around the solid fuel injection tube, defining a second flow path through which the gas fuel passes between the gas fuel injection tube and an outer wall of the solid fuel injection tube, and configured to inject the gas fuel from a tip of the second flow path;

a combustion-supporting gas injection tube arranged around the gas fuel injection tube, defining a third flow path through which a combustion-supporting gas passes between the combustion-supporting gas injection tube and an outer wall of the gas fuel injection tube, and configured to inject the combustion-supporting gas from a tip of the third flow path;

a plurality of first vanes arranged in the third flow path at a predetermined interval in a circumferential direction of the third flow path; and a plurality of second vanes arranged in the second flow path at a predetermined interval in a circumferential direction of the second flow path, wherein the plurality of first vanes form an angle $\theta_1$ with a burner axis and the plurality of second vanes form an angle $\theta_2$ with the burner axis, the angles satisfying a relationship $\theta_1<\theta_2$.

[2] The auxiliary burner for an electric furnace according to [1], wherein the angle $\theta_1$ is 10° or more and 50° or less, and the angle $\theta_2$ is 20° or more and 75° or less.

[3] The auxiliary burner for an electric furnace according to [1] or [2], wherein $\theta_2-\theta_1$ is 15° or more and 45° or less.

[4] The auxiliary burner for an electric furnace according to [2] or [3], wherein when each of the first vanes has a length $Q_1$ in the circumferential direction of the third flow path and the plurality of first vanes have an installation interval $P_1$ in the circumferential direction of the third flow path, $Q_1/P_1$ is 1.0 or more and 1.2 or less; and when each of the second vanes has a length $Q_2$ in the circumferential direction of the second flow path and the plurality of second vanes have an installation interval $P_2$ in the circumferential direction of the second flow path, $Q_2/P_2$ is 1.0 or more and 1.2 or less.

[5] The auxiliary burner for an electric furnace according to [1], wherein the angle $\theta_1$ is 0°, and the angle $\theta_2$ is 10° or more and 70° or less.

[6] The auxiliary burner for an electric furnace according to [5], wherein the angle $\theta_2$ is 45° or more and 60° or less.

[7] The auxiliary burner for an electric furnace according to [5] or [6], wherein when each of the second vanes has a length $Q_2$ in the circumferential direction of the second flow path and the plurality of second vanes have an installation interval $P_2$ in the circumferential direction of the second flow path, $Q_2/P_2$ is 1.0 or more and 1.2 or less.

Advantageous Effect

According to the auxiliary burner of the present disclosure, it is possible to increase and homogenize the heating effect of the iron scrap by suitably and efficiently burning the solid fuel along with the gas fuel.

Figure 1:
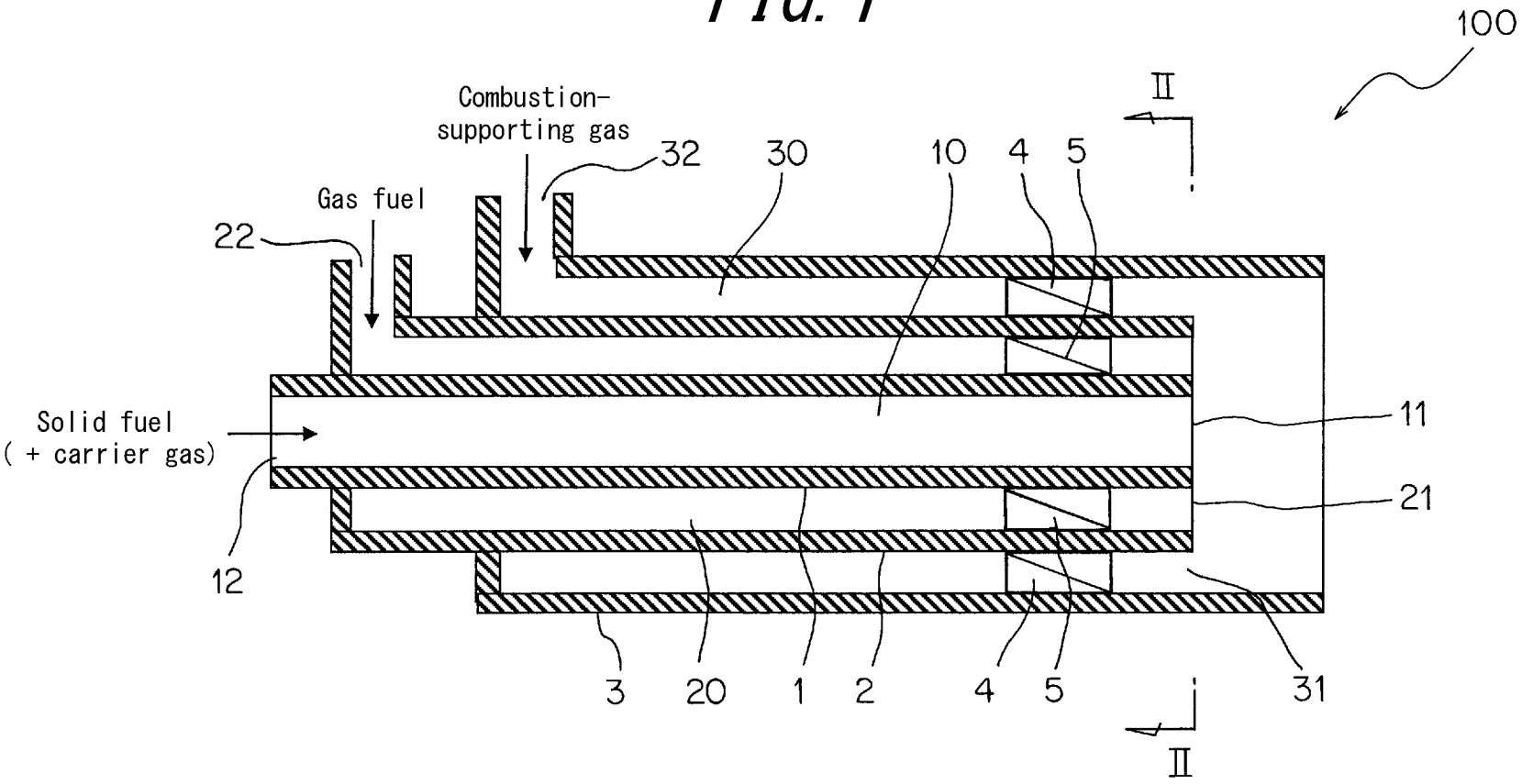
FIG. 1 is a cross-sectional view taken along the burner axis of an auxiliary burner 100 for an electric furnace according to a first embodiment of the present disclosure.
Figure 2:
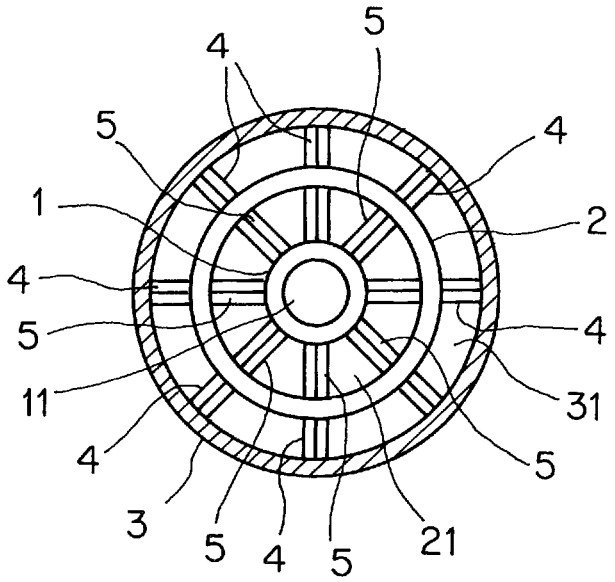
FIG. 2 is a cross-sectional view taken along line II-II of FIG. 1.

DETAILED DESCRIPTION (Auxiliary Burner for Electric Furnace According to First Embodiment)

Hereinafter, an auxiliary burner 100 for an electric furnace according to a first embodiment of the present disclosure is described with reference to FIGS. 1 to 4. The auxiliary burner 100 according to the present embodiment is attached to an electric furnace for manufacturing molten iron by melting iron scrap, and uses gas fuel and solid fuel as fuel.

In the auxiliary burner 100, the body part for supplying fuel and combustion-supporting gas has a triple tube structure in which a solid fuel injection tube 1, a gas fuel injection tube 2, and a combustion-supporting gas injection tube 3 are arranged coaxially in the stated order from the center side. The solid fuel injection tube 1 defines a solid fuel flow path 10 (first flow path) through which solid fuel passes, and injects solid fuel from a circular solid fuel discharge port 11 which is the tip of the solid fuel flow path 10. The gas fuel injection tube 2, which is arranged around the solid fuel injection tube 1, defines a gas fuel flow path 20 (second flow path) through which gas fuel passes between the gas fuel injection tube 2 and the outer wall of the solid fuel injection tube 1, and injects gas fuel from a ring-shaped gas fuel discharge port 21 which is the tip of the gas fuel flow path 20. The combustion-supporting gas injection tube 3, which is arranged around the gas fuel injection tube 2, defines a combustion-supporting gas flow path 30 (third flow path) through which combustion-supporting gas passes between the combustion-supporting gas injection tube 3 and the outer wall of the gas fuel injection tube 2, and injects combustion-supporting gas from a ring-shaped combustion-supporting gas discharge port 31 which is the tip of the combustion-supporting gas flow path 30.

The tip of the auxiliary burner 100 is such that, the tips of the solid fuel injection tube 1 and the gas fuel injection tube 2 are located at the same position along the burner axis, and only the tip of the outermost combustion-supporting gas injection tube 3 protrudes by about 10 mm to 200 mm. The inner diameter of each of the injection tubes 1, 2 and 3 is not particularly limited; and generally, the inner diameter of the solid fuel injection tube 1 is about 10 mm to 40 mm, the inner diameter of the gas fuel injection tube 2 is about 20 mm to 60 mm, and the inner diameter of the combustion-supporting gas injection tube 3 is about 40 mm to 100 mm. Also, the thickness of each injection tube is not particularly limited, and is generally about 2 mm to 20 mm.

On the rear end side of the burner, a combustion-supporting gas supply port 32, through which combustion-supporting gas is supplied to the combustion-supporting gas flow path 30, is provided on the burner rear end side of the combustion-supporting gas injection tube 3. Similarly, a gas fuel supply port 22, through which gas fuel is supplied to the gas fuel flow path 20, is provided on the burner rear end side of the gas fuel injection tube 2. Also similarly, a solid fuel supply port 12, through which solid fuel is supplied along with carrier gas to the solid fuel flow path 10, is provided on the burner rear end side of the solid fuel injection tube 1.

A combustion-supporting gas supply mechanism (a combustion-supporting gas feeder being not illustrated), which supplies combustion-supporting gas to the combustion-supporting gas supply port 32, is connected to the combustion-supporting gas supply port 32. Also, a gas fuel supply mechanism (a gas fuel feeder being not illustrated), which supplies gas fuel to the gas fuel supply port 22, is connected to the gas fuel supply port 22. Additionally, a solid fuel supply mechanism and a carrier gas supply mechanism (a solid fuel feeder and a carrier gas feeder both being not illustrated), which supply solid fuel and carrier gas to the solid fuel supply port 12, is connected to the solid fuel supply port 12.

Further, although it is not illustrated, an inner tube and an outer tube are further arranged coaxially outside the combustion-supporting gas injection tube 3; and cooling fluid flow paths (a forward path and a return path for cooling fluid) communicating with each other are formed between the outer tube and the inner tube, and between the inner tube and the combustion-supporting gas injection tube 3.

Examples of fuels that can be used in the auxiliary burner of the present embodiment are as follows. Examples of the gas fuel include LPG (Liquefied Petroleum Gas), LNG (Liquefied Natural Gas), hydrogen, steelworks by-product gases (Cokes Oven gas, Blast Furnace gas and the like), and mixed gases including two or more thereof; and one or more thereof can be used. Further, examples of the solid fuel include powdered solid fuels such as coal (pulverized coal) and plastic (granular or powdery ones including waste plastic); and one or more thereof can be used. However, coal (pulverized coal) is particularly preferred. Furthermore, examples of the combustion-supporting gas include pure oxygen (industrial oxygen), oxygen-enriched air, and air; and anyone thereof may be used. However, pure oxygen is preferred. As the carrier gas, for example, nitrogen can be used.

[Reason for Setting Combustion-Supporting Gas Injection Tube as the Outermost Circumference]

The combustion-supporting gas has the largest flow rate among the supplied gas amount, and in order to match the flow speed thereof with that of other supplied gases (gas fuel and carrier gas), it is necessary to make the discharge area of the combustion-supporting gas discharge port 31 larger than that of the gas fuel discharge port 21 and the solid fuel discharge port 11. From the above viewpoint, it is optimal to set the combustion-supporting gas injection tube 3 as the outermost circumference. Hereinafter, an example in which oxygen as the combustion-supporting gas, LNG as the gas fuel, and pulverized coal as the solid fuel are used is described.

Initially, the amount of oxygen required for combustion is calculated by the following equation (1):

amount of oxygen required for combustion=oxygen ratio (coefficient)×[flow rate of LNG×theoretical oxygen amount of LNG+supply amount of pulverized coal×theoretical oxygen amount of pulverized coal] (1).

The amount of oxygen required for combustion is specifically calculated under the following conditions. That is, as calculation conditions, the amount of heat generated by LNG is set to 9700 kcal/$Nm^3$, and the amount of heat generated by pulverized coal, the solid fuel, is set to 7500 kcal/kg. In addition, the total energy of the auxiliary burner is set such that, 90% thereof is supplied by the solid fuel, and 10% thereof is supplied by the gas fuel. For example, when LNG is supplied at 6.2 $Nm^3$/h, the amount of heat generated is 60 Mcal/h. In this case, it is necessary to supply 540 Mcal/h, which is the difference from 600 Mcal/h, the total amount of heat to be generated by the burner, from pulverized coal, and therefore the supply amount of pulverized coal is about 72 kg/h. Further, the theoretical oxygen amount is calculated from the carbon content and the hydrogen content in the fuel; and particularly, the theoretical oxygen amount of LNG is about 2.25 $Nm^3/Nm^3$, and the theoretical oxygen amount of pulverized coal is about 1.70 $Nm^3$/kg.

Generally, the oxygen ratio is under an oxygen excess condition of 1.0 to 1.1; and when the oxygen ratio is 1.1, the amount of oxygen required for combustion is calculated as 150 $Nm^3$/h (=1.1×[6.2×2.25+72×1.7]) according to the above equation (1). Accordingly, when pure oxygen is used, about 25 times the flow rate of the LNG fuel is necessary. In addition, compared with nitrogen for carrying the pulverized coal, the nitrogen flow rate is about 5.8 $Nm^3$/h when the solid-gas ratio (supply rate of solids per unit time/supply rate of carrier gas per unit time) is 12, and therefore, about 26 times the flow rate is necessary. Accordingly, in order to make the discharge speed of oxygen equal to the discharge speed of fuel gas and pulverized coal, the combustion-supporting gas discharge port 31 needs to have a discharge area (radial cross-sectional area) 20 times or more those of the gas fuel discharge port 21 and the solid fuel discharge port 11. Therefore, in view of the layout of the burner, it is reasonable to arrange the combustion-supporting gas discharge port 31 at the outermost circumferential part of the burner. When air is used instead of pure oxygen as the combustion-supporting gas, a further 5 times the flow rate is necessary. Also in this case, it is reasonable to arrange the combustion-supporting gas discharge port 31 at the outermost circumferential part of the burner for the same reason.

[Swirl Vanes]

In the combustion-supporting gas flow path 30, a plurality of swirl vanes 4 (first vanes) for swirling (in the burner circumferential direction, which shall also apply thereafter) the combustion-supporting gas are provided at predetermined intervals in the circumferential direction thereof. Also, in the gas fuel flow path 20, a plurality of swirl vanes 5 (second vanes) for swirling the gas fuel are provided at predetermined intervals in the circumferential direction thereof. By swirling the combustion-supporting gas and the gas fuel by the swirl vanes 4 and 5 provided under specific conditions in this manner, it is possible to burn the solid fuel along with the gas fuel suitably and efficiently, and thereby the heating effect of the scrap is improved and the flame temperature of the burner is homogenized. As a result, the scrap in the electric furnace can be efficiently heated or melted.

Elements necessary for combustion include combustible substance, oxygen, and temperature (fire source). Regarding the state of the combustible substance, the ease of combustion is in the order of gas, liquid and solid. This is because when the combustible substance is in a gaseous state, it is easy to mix the combustible substance with oxygen, such that combustion is continued (chain reaction).

When a gas fuel is burned as a combustible substance using an auxiliary burner, generally, the gas fuel burns immediately after being injected from the tip of the burner, although it depends on the oxygen concentration, the flow speed of the gas fuel, and the shape of the burner tip. On the other hand, when a solid fuel typified by coal is used as a combustible substance, it is difficult for it to burn as quickly as a gas fuel. This is due to the fact that it is necessary to maintain the ignition temperature of coal, which is about 400° C. to 600° C., and it takes time to raise the temperature up to the ignition temperature.

The heat-up time for a solid fuel to reach its ignition temperature depends on the particle size (specific surface area) of the solid fuel, and it is possible to shorten the ignition time by making the particles finer. This is because combustion reaction proceeds by maintaining the ignition temperature and reacting the combustible substance with oxygen. In order to efficiently proceed the combustion reaction, it is important to heat the coal efficiently and then react the coal with oxygen.

The auxiliary burner of the present embodiment, by swirling the gas, improves the aforementioned efficient heating of coal and reaction of a combustible substance and oxygen.

Hereinafter, an example in which LNG (Liquefied Natural Gas) as the gas fuel, coal (pulverized coal) as the solid fuel, and pure oxygen as the combustion-supporting gas are used is described. Note that the ignition temperature of fuel is generally solid fuel >liquid fuel >gas fuel.

When LNG and coal are used as the fuel of the auxiliary burner, a combustion field above the ignition temperature of coal is created due to the combustion of LNG and pure oxygen, and as the coal is fed into the combustion field, the temperature of the coal rises to the ignition temperature, and thus combustion of the coal (vaporization ignition) occurs. Although the flame temperature drops due to the fact that the amount of heat required to raise the temperature of the coal is consumed, the temperature rises in the region where ignition of the coal occurs.

The reaction of LNG and coal as the fuel and oxygen generates carbon dioxide, an incombustible gas. An incombustible gas inhibits continuation of combustion (chain reaction), which causes deterioration in combustibility. Further, the coal is supplied along with a carrier gas. When the flow rate of the carrier gas is high, the temperature drops corresponding to the specific heat of the carrier gas. Therefore, generally, the combustibility can be improved by increasing the solid-gas ratio. However, the state in which the solid-gas ratio is large is such that the coal is dense, and it is difficult for external heat and reaction with oxygen to be transmitted to the center part. In order to efficiently burn the coal, it is important to create a condition under which heat and oxygen are sufficiently present around the coal in the combustion field of the coal.

As a result of studies by the inventors, it was found that by swirling the oxygen (combustion-supporting gas) and the LNG (gas fuel) under specific conditions, it is possible to burn the coal, LNG, and the oxygen homogeneously while mixing them efficiently and obtain high combustibility. That is, the LNG and coal react with the oxygen rapidly, the coal is efficiently heated by the reaction heat, and carbon dioxide generated by the reaction is diffused by the swirling of the oxygen. Therefore, the combustibility was found to be improved.

That is, in the present embodiment, it is important that the angle $\theta_1$ formed between the plurality of swirl vanes 4 provided in the combustion-supporting gas flow path 30 and the burner axis (see FIG. 3) and the angle $\theta_2$ formed between the plurality of swirl vanes 5 provided in the gas fuel flow path 20 and the burner axis (see FIG. 4) satisfy the relationship $\theta_1<\theta_2$. The reason for this is as follows. In order to promote mixing of the solid fuel and the gas fuel with the combustion-supporting gas by swirling the combustion-supporting gas and the gas fuel, generally, it is effective to increase the swirl angle (angle $\theta$ formed between the swirl vanes and the burner axis). However, in the auxiliary burner of the present embodiment, the combustion-supporting gas is injected from the outermost circumference, and thus a too large swirl angle may cause it to diffuse too much. On the other hand, since the gas fuel is injected from the inside of the combustion-supporting gas, even if the swirl angle thereof is larger than that of the combustion-supporting gas, it does not diffuse to the surroundings due to the presence of the combustion-supporting gas flow at the outer circumference thereof, and increasing the swirl angle would rather promote the mixing. That is, it is important to increase the swirl angle of the gas fuel injected from the inside of the combustion-supporting gas in the geometrical configuration of the nozzle.

As described above, the angle $\theta_1$ and the angle $\theta_2$ should satisfy the relationship $\theta_1<\theta_2$, and from the viewpoint of obtaining the above effect more reliably, it is desirable that $\theta_2-\theta_1$ is 15° or more and 45° or less.

Further, from the viewpoint of obtaining the effect of the present disclosure more reliably, it is preferable that the angle $\theta_1$ of the swirl vanes 4 provided in the combustion-supporting gas flow path 30 is 10° or more and 50° or less; and the angle $\theta_2$ of the swirl vanes 5 provided in the gas fuel flow path 20 is 20° or more and 75° or less.

When the angle $\theta_1$ of the swirl vanes 4 is less than 10°, there is a possibility that the combustion-supporting gas cannot be sufficiently swirled. On the other hand, when the angle $\theta_1$ of the swirl vanes 4 exceeds 50°, the combustion-supporting gas diffuses too much to the outside, and thus it may become impossible to create the condition under which heat and oxygen are sufficiently present around the coal in the combustion field. From the above viewpoint, it is more preferable that the angle $\theta_1$ of the swirl vanes 4 is 20° or more and 45° or less.

Also, when the angle $\theta_2$ of the swirl vanes 5 is less than 20°, there is a possibility that the gas fuel cannot be sufficiently swirled. On the other hand, when the angle $\theta_2$ of the swirl vanes 5 exceeds 75°, mixing with the combustion-supporting gas tends to be insufficient, and thus stagnation region may occur, which may result in insufficient combustion. From the above viewpoint, it is more preferable that the angle $\theta_2$ of the swirl vanes 5 is 45° or more and 65° or less.

No particular limitations are placed on the number and the thickness of the swirl vanes 4 and 5; however, in order to sufficiently swirl the gas (the combustion-supporting gas and the gas fuel) without disturbing the gas flows and causing the vanes to deform, it is appropriate that the number of the swirl vanes 4 and 5 is respectively 8 or more and 16 or less, and the thickness of the vanes is about 1 mm to 10 mm.

Further, no particular limitations are placed on the installation positions of the swirl vanes 4 and 5 in the burner axis direction as long as they are within the gas flow paths (the combustion-supporting gas flow path 30 and the gas fuel flow path 20); however, if the vanes are located too far from the tips of the gas flow paths (the combustion-supporting gas discharge port 31 and the gas fuel discharge port 21), there is a possibility that the intended swirl angles cannot be maintained before the gases that have passed through the swirl vanes 4 and 5 mix. On the other hand, if the installation positions of the swirl vanes 4 and 5 are too close to the tips of the gas flow paths (the combustion-supporting gas discharge port 31 and the gas fuel discharge port 21), since the run-up time for maintaining the swirl angles is short, swirl flows (combustion-supporting gas flow and gas fuel flow) holding the intended swirl angles are less likely to occur. Therefore, it is preferable that, the distance $L_{B1}$ between the tip on the combustion-supporting gas discharge port 31 side of each swirl vane 4 and the combustion-supporting gas discharge port 31 in the burner axis direction illustrated in FIG. 3, and the distance $L_{B2}$ between the tip on the gas fuel discharge port 21 side of each swirl vane 5 and the gas fuel discharge port 21 in the burner axis direction illustrated in FIG. 4, are each about 10 mm to 50 mm.

Figure 3:
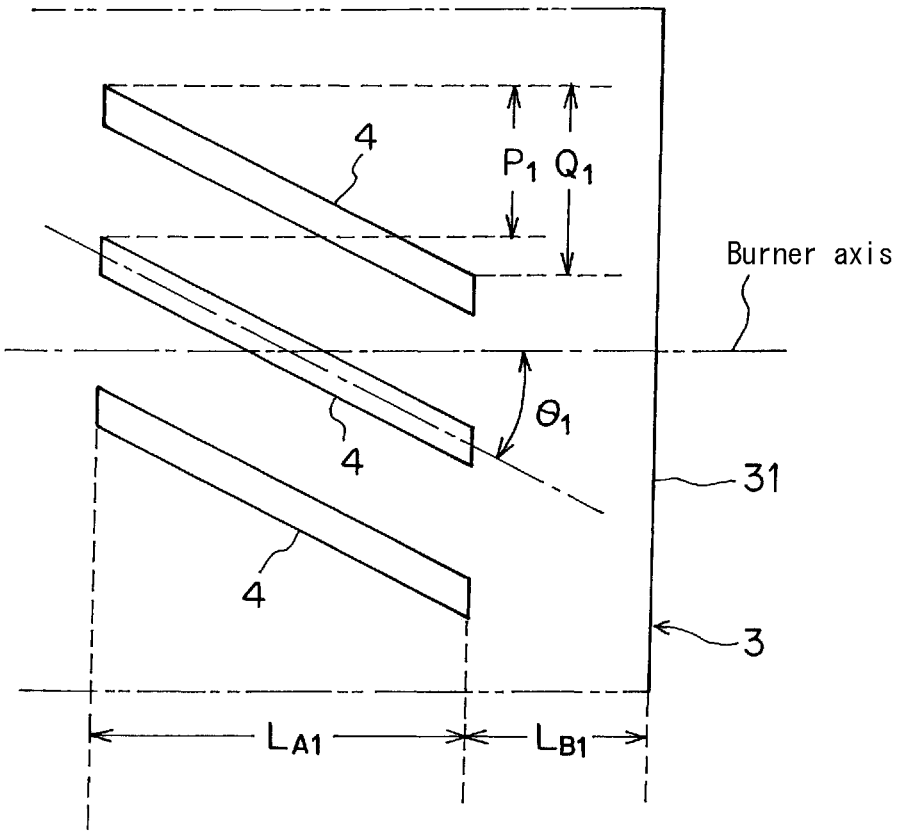
FIG. 3 illustrates a part of a plurality of swirl vanes 4 provided in the auxiliary burner 100 of FIG. 1 with a combustion-supporting gas injection tube 3 developed in its circumferential direction.
Figure 4:
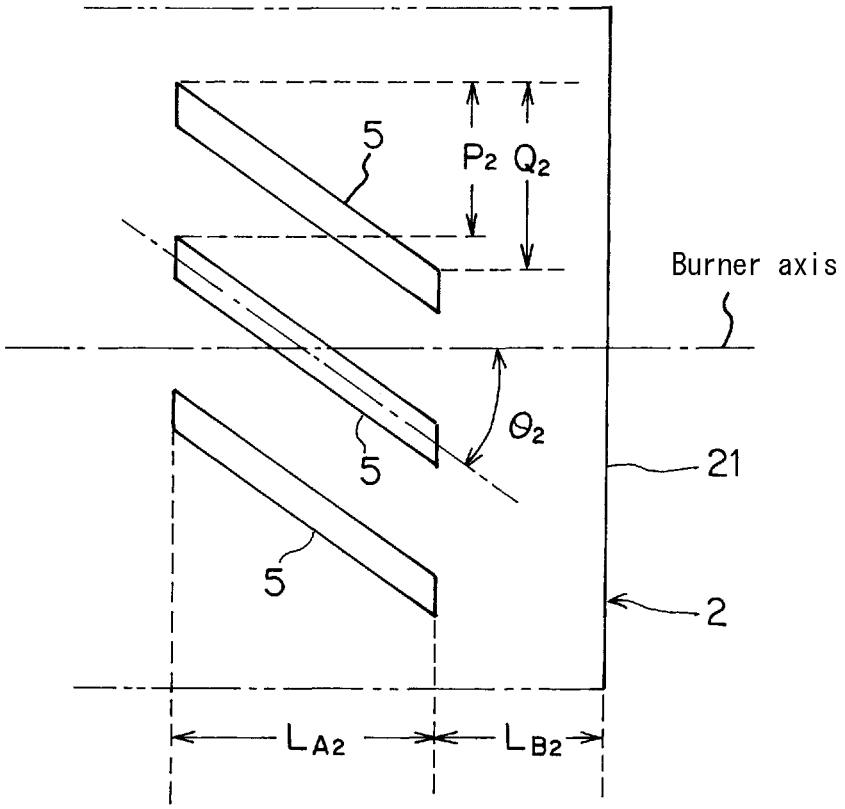
FIG. 4 illustrates a part of a plurality of swirl vanes 5 provided in the auxiliary burner 100 of FIG. 1 with a gas fuel injection tube 2 developed in its circumferential direction.

Further, it is preferable that, each swirl vane 4 has a length $L_{A1}$ in the burner axis direction as illustrated in FIG. 3, each swirl vane 5 has a length $L_{A2}$ in the burner axis direction as illustrated in FIG. 4, and $L_{A1}$ and $L_{A2}$ are each 20 mm or more, such that stable swirl flows can be obtained. In addition, it is preferable that the lengths $L_{A1}$ and $L_{A2}$ are each 100 mm or less from the viewpoint of manufacturing cost of the vanes.

Furthermore, as illustrated in FIG. 3, when each swirl vane 4 has a length $Q_1$ in the circumferential direction of the combustion-supporting gas flow path 30 (the circumferential length), and the swirl vanes 4 have intervals $P_1$ in the circumferential direction of the combustion-supporting gas flow path 30, it is preferable that $Q_1/P_1$ (the lap ratio) is 1.0 or more and 1.2 or less. Similarly, as illustrated in FIG. 4, when each swirl vane 5 has a length $Q_2$ in the circumferential direction of the gas fuel flow path 20 (the circumferential length), and the swirl vanes 5 have intervals $P_2$ in the circumferential direction of the gas fuel flow path 20, it is preferable that $Q_2/P_2$ (the lap ratio) is 1.0 or more and 1.2 or less. When $Q_1/P_1$ or $Q_2/P_2$ is less than 1.0, it becomes difficult to swirl the gas flows, and as a result, it is difficult to homogenize the flame temperature. On the other hand, when $Q_1/P_1$ or $Q_2/P_2$ exceeds 1.2, the resistance when the gases flow increases, such that the pressure loss against the gas flows becomes larger and it becomes difficult for the flows to flow. As a result, it is also difficult to homogenize the flame temperature. As illustrated in FIG. 3, all of the swirl vanes 4 have the same distance $L_{B1}$, length $L_{A1}$ in the burner axis direction, and circumferential length $Q_1$, and it is preferable that the intervals $P_1$ are also the same. Also, as illustrated in FIG. 4, all of the swirl vanes 5 have the same distance $L_{B2}$, length $L_{A2}$ in the burner axis direction, and circumferential length $Q_2$, and it is preferable that the intervals $P_2$ are also the same.

It is preferable that the swirl direction of the swirl vanes 4 and the swirl direction of the swirl vanes 5 are the same; however, the swirl directions may be different.

Each of the swirl vanes 4 and 5 may be incorporated into the corresponding tube body (injection tube), or may be machined to have an integral structure with the corresponding tube body.

(Auxiliary Burner for Electric Furnace According to Second Embodiment)

Hereinafter, an auxiliary burner 200 for an electric furnace according to a second embodiment of the present disclosure is described with reference to FIGS. 1 to 7. The auxiliary burner 200 of the present embodiment has the same configuration as that of the auxiliary burner 100 according to the first embodiment except for the configuration of the swirl vanes. Therefore, the configuration of the swirl vanes is mainly described below, and the description of the first embodiment is cited for the rest.

[Swirl Vanes]

In the present embodiment, only the gas fuel flow path 20 is provided with a plurality of swirl vanes 5 for swirling the gas fuel at a predetermined interval in the circumferential direction thereof. That is, the combustion-supporting gas flow path 30 is not provided with any swirl vanes. However, the combustion-supporting gas flow path 30 is provided with first vanes (not illustrated in FIG. 5) having the angle $\theta_1$ described in the first embodiment of 0° for the purpose of holding the gas fuel injection tube 2 and the combustion-supporting gas injection tube 3 coaxially, not for the purpose of swirling the combustion-supporting gas.

By swirling the gas fuel by the swirl vanes 5 provided under specific conditions in this manner, the promotion effect of mixing the gas fuel, the solid fuel, and the combustion-supporting gas is obtained, such that the solid fuel can be burned along with the gas fuel suitably and efficiently, thereby the scrap heating effect is improved and the flame temperature of the burner is homogenized. As a result, the scrap within the electric furnace can be efficiently heated or melted.

In the present embodiment, the combustion-supporting gas moves straight without swirling. Therefore, even if the gas fuel is swirled with a relatively large swirl angle, since the combustion-supporting gas that moves straightly serves as a kind of wall, the gas fuel does not diffuse outwardly, such that the combustibility does not decrease. Further, by swirling only the gas fuel without swirling the combustion-supporting gas, it is possible to promote mixing while ensuring the straightness of the combustion-supporting gas, such that the straightness of the burner flame can be improved. That is, as will be described with reference to FIG. 9, the length of the burner flame can be lengthened. Therefore, it can be said that the auxiliary burner 200 of the present embodiment is particularly useful when it is necessary to increase the straightness of the burner flame.

As a result of studies by the inventors, it was found that in the present embodiment, by swirling the gas fuel under specific conditions, it is possible to burn the coal and the LNG with the oxygen homogeneously while mixing them efficiently and obtain high combustibility. That is, the reaction between the LNG and coal and the oxygen proceeds rapidly, the coal is efficiently heated by the reaction heat, and carbon dioxide generated by the reaction is diffused by the swirling of the gas fuel. Therefore, the combustibility was found to be improved.

In the present embodiment, it is necessary to set the angle $\theta_2$ formed between the swirl vanes 5 and the burner axis (see FIG. 7) to be 10° or more and 70° or less. When the angle $\theta_2$ is less than 10°, the gas fuel cannot be sufficiently swirled, such that the effect aimed by the present disclosure (the mixing promoting effect) described above cannot be sufficiently obtained. On the other hand, even if the angle $\theta_2$ exceeds 70°, the mixing promoting effect can be obtained; however, the straightness of the burner flame is deteriorated, such that the length of the burner flame is shortened. From the above viewpoint, the angle $\theta_2$ is preferably 10° or more and 70° or less, and more preferably 45° or more and 60° or less.

Figure 7:
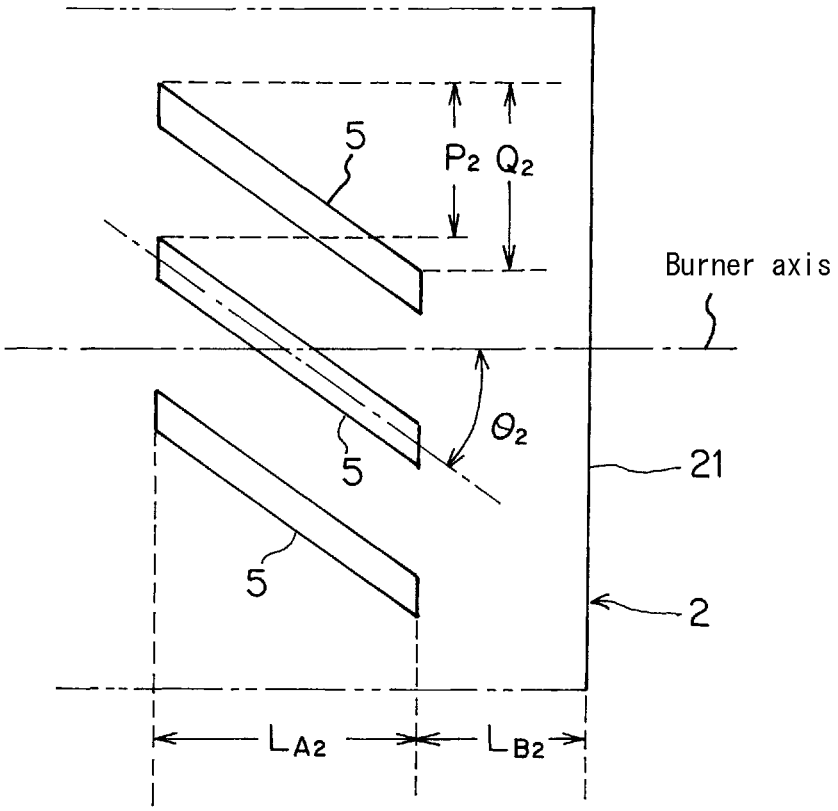
FIG. 7 illustrates a part of a plurality of swirl vanes 5 provided in the auxiliary burner 200 of FIG. 5 with a gas fuel injection tube 2 developed in its circumferential direction.

Note that, preferable conditions for the number and the thickness of the swirl vanes 5, the distance $L_{B2}$ between the tip on the gas fuel discharge port 21 side of each swirl vane 5 and the gas fuel discharge port 21, the length $L_{A2}$ of each swirl vane 5 in the burner axis direction, $Q_2/P_2$ (the lap ratio) illustrated in FIG. 7 and the like, and the reason for setting the combustion-supporting gas injection tube 3 as the outermost circumference, and the like, are the same as those described in the first embodiment.

According to any one of the auxiliary burners 100 and 200 of the first and the second embodiments of the present disclosure described above, by burning the solid fuel along with the gas fuel suitably and efficiently, the scrap heating effect is improved, and the flame temperature of the burner is homogenized. Therefore, it is possible to efficiently heat or melt iron scrap using inexpensive solid fuels such as coal. Besides, an auxiliary burner 100, 200 of the present embodiment has the following additional effects. That is, in the present embodiment, by changing the ratio of the solid fuel to the total fuel (Generated heat amount conversion, and hereinafter simply referred to as "the solid fuel ratio"), it is possible to arbitrarily adjust the flame length according to the distance to the scrap to be heated or melted. Further, generally, since the gas flow speed in an auxiliary burner is relatively small, splashes of molten iron and molten slag splattered may clog the gas discharge ports; however, in the present embodiment, since the splashes are purged by the carrier gas of the solid fuel, clogging of the gas discharge ports due to splashes is less likely to occur.

Figure 8:
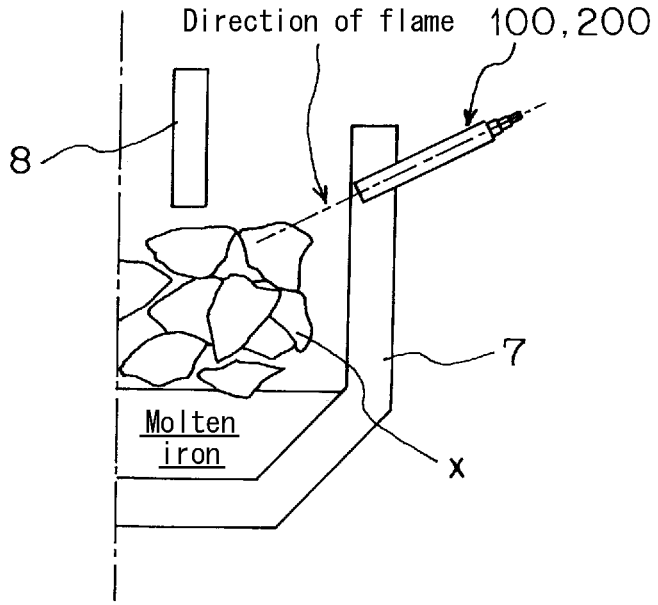
FIG. 8 schematically illustrates an example of working condition of an auxiliary burner 100, 200 according to an embodiment of the present disclosure.

FIG. 8 schematically illustrates an example of working condition of the auxiliary burner 100, 200 of the present embodiment (a longitudinal section in the radial direction of the electric furnace), wherein 7 is a furnace body, 8 is an electrode, 100, 200 is the auxiliary burner, and x is scrap. The auxiliary combustion burner 100, 200 is installed with an appropriate dip angle. Generally, a plurality of auxiliary burners 100, 200 are installed such that the scrap located at the so-called cold spots within the electric furnace can be heated or melted.

Here, the length of the flame varies depending on the ignition temperature of the fuel used for the auxiliary burner. Since solid fuel and gas fuel have different ignition temperatures, by changing the solid fuel ratio, the flame length of the auxiliary burner (that is, the flame temperature at a certain distance away from the burner) can be arbitrarily adjusted.

As described above, in the auxiliary burner of the present embodiment, a combustion field above the ignition temperature of solid fuel is created due to the combustion of the gas fuel and the combustion-supporting gas. As the solid fuel is fed into this combustion field, the temperature of the solid fuel rises to the ignition temperature, and combustion of the solid fuel (vaporization→ignition) occurs. Although the flame temperature decreases due to the fact that the amount of heat required to raise the temperature of the solid fuel is consumed, the temperature rises in the region where ignition of the solid fuel occurs. Accordingly, the flame generated by the auxiliary burner of the present embodiment is such that, when the solid fuel ratio is low, positions near the tip of the burner become high temperature (that is, a short flame is generated); and when the solid fuel ratio is increased, positions far from the tip of the burner also become high temperature (that is, a long flame is generated) due to the heat generation of the solid fuel after heat absorption. Therefore, by changing the solid fuel ratio, the flame length (that is, the flame temperature at a certain distance away from the burner) can be controlled.

Figure 9:
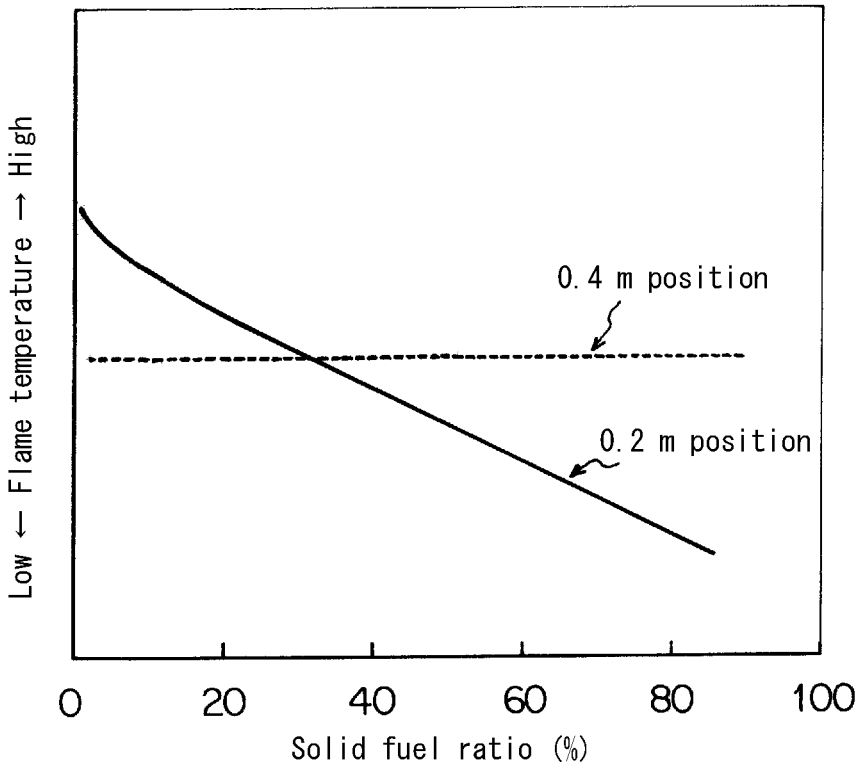
FIG. 9 is a graph for explaining the variation in flame length when the ratio of solid fuel to the total fuel is changed for an auxiliary burner according to an embodiment of the present disclosure.

FIG. 9 schematically illustrates the variation in flame length when the solid fuel ratio is changed for the auxiliary burner of the present embodiment. In FIG. 9, the solid line is the flame temperature at a position away from the tip of the burner by 0.2 m in the burner axis direction, the broken line is the flame temperature at a position away from the tip of the burner by 0.4 m in the same direction, and the horizontal axis is the ratio of solid fuel to the total of gas fuel and solid fuel. According to FIG. 9, under the condition where the solid fuel ratio is low, the flame temperature at the 0.2 m position near the burner is high; however, at the 0.4 m position, the temperature decreases in a rapid manner. That is, the flame length is short. On the other hand, under the condition where the solid fuel ratio is high, the flame temperature at the 0.2 m position near the burner is lower than that in the case of 100% gas fuel; however, even at the 0.4 m position, almost no temperature decrease occurs. That is, the flame length is long. This is because, in the vicinity of the burner, the gas fuel is preferentially burned, and the solid fuel heated to a high temperature in the flame is burned at the 0.4 m position, such that the temperature is maintained.

In the operation of the electric furnace, the distance between the auxiliary burner and the scrap varies due to charging, addition and melting of the scrap. Generally, the distance between the auxiliary burner and the scrap is small at the beginning of operation and at the initial stage after addition, and increases with the progress of melting of the scrap. This is because, the scrap is melted in order from the part near the auxiliary burner, such that the distance between the unmelted scrap and the auxiliary burner gets larger with the progress of melting of the scrap. In the auxiliary burner of the present embodiment, the flame length can be adjusted (changed) by changing the solid fuel ratio according to the distance to the scrap to be heated or melted, such that regardless of the distance between the scrap and the auxiliary burner, the flame can reach the scrap. That is, when the distance between the auxiliary burner and the scrap is small, the solid fuel ratio is decreased to shorten the flame length; and when the distance between the auxiliary burner and the scrap is large, the solid fuel ratio is increased to lengthen the flame length. Thereby, the scrap can be efficiently heated or melted.

Particularly, in general operation (one charge operation) of the electric furnace, scrap is charged about two to three times. Operation of the electric furnace after the first scrap charging begins when energizing starts or when the use of the auxiliary burner is started. As for the state at the start of operation, there are cases where some of the molten iron in the previous operation is left and molten metal exists in the lower part and where the molten iron in the previous operation is all discharged and the inside of the furnace is empty; however, there is no big difference in the operation method. At the initial stage after scrap charging, the bulk density is high and the whole electric furnace is filled with the scrap. Accordingly, the tip of the auxiliary burner is close to the scrap. The distance between the tip of the auxiliary burner and the scrap at the initial stage after scrap charging is about 0.5 m. This is because, when the tip of the auxiliary burner is too close to the scrap, splashes generated when the scrap melts will weld to the auxiliary burner. The position of the height of the tip of the auxiliary burner depends on the characteristics of the furnace; however, is generally 1 m or more above the height of molten metal surface after burn-through of the scrap.

As the operation proceeds, melting of the scrap proceeds from the lower part in contact with the molten iron, the vicinity of the electrode, and the vicinity of the auxiliary burner. At the initial stage after scrap charging, the top scrap falls with melting, and thus the scrap in the vicinity of the auxiliary burner always has a distance to the auxiliary burner of about 0.5 m; however, the distance increases when the top scrap runs out. Since the heat of the auxiliary burner cannot be efficiently supplied to the scrap when the distance to the scrap increases, conventionally, sometimes operation to stop the auxiliary burner was performed. On the other hand, in the operation using the auxiliary burner of the present embodiment, when the scrap is near, the solid fuel ratio is decreased to melt the scrap with a short flame; and when the distance to the scrap increases as the melting proceeds, the solid fuel ratio is increased to melt the scrap with a long flame. This makes it possible to melt more scrap efficiently and enables reduction of operation time and power consumption unit. The distance between the auxiliary burner and the scrap varies due to two to three times of scrap charging, and by appropriately changing the solid fuel ratio each time, the scrap can be efficiently melted.

In the case of the operation described above, it is necessary to grasp the distance between the auxiliary burner and the scrap; and for example, it is possible to install a laser range finder at the auxiliary burner, and measure the distance to the scrap by the laser range finder. Also, it is possible to observe the situation inside the furnace with a monitoring camera through a window such as a discharge port; and depending on the structure of the electric furnace, is possible to grasp the distance to the scrap through observation on the inside of the furnace by the monitoring camera. In addition, useful information for grasping the distance may be obtained from the operation data.

EXAMPLES

Example 1

A steel plate was heated using an auxiliary burner having the structure illustrated in FIGS. 1 to 4, and the temperature thereof was measured. The combustion conditions of the burner are listed in Table 1.

LNG (gas fuel) and pulverized coal (solid fuel) were used as the fuel, and pure oxygen was used as the combustion-supporting gas. The pulverized coal was injected from the solid fuel injection tube at the center with nitrogen as the carrier gas, the LNG was injected from the gas fuel injection tube outside the solid fuel injection tube, and the pure oxygen was injected from the combustion-supporting gas injection tube outside the gas fuel injection tube (the outermost circumference). The specifications of the pulverized coal are listed in Table 2.

The angle $\theta_1$ of the swirl vanes in the combustion-supporting gas injection tube, the angle $\theta_2$ of the swirl vanes in the gas fuel injection tube, the value of $Q_1/P_1$, and the value of $Q_2/P_2$ at each level were presented in Table 3. Note that, the swirl vanes with an angle of 0° are provided as members to coaxially hold the gas fuel injection tube 2 and the combustion-supporting gas injection tube 3, and the solid fuel injection tube 1 and the gas fuel injection tube 2, not for the purpose of swirling the combustion-supporting gas and the gas fuel. At all levels, the number of swirl vanes was 8, $L_{B1}$ and $L_{B2}$ were 40 mm, and $P_1$ and $P_2$ were 30 mm.

Figure 10B:
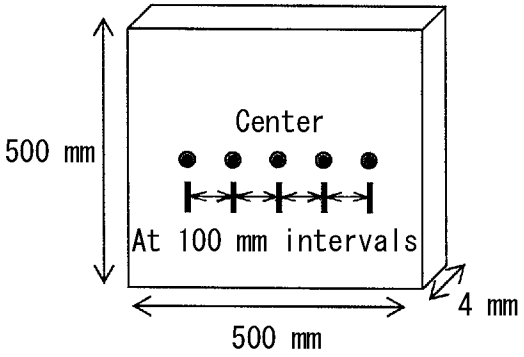
FIGS. 10A and 10B respectively illustrate a method of combustion test of an auxiliary burner conducted in Examples, and the installation positions of thermocouples with respect to the steel plate used in the combustion test.
Figure 10A:
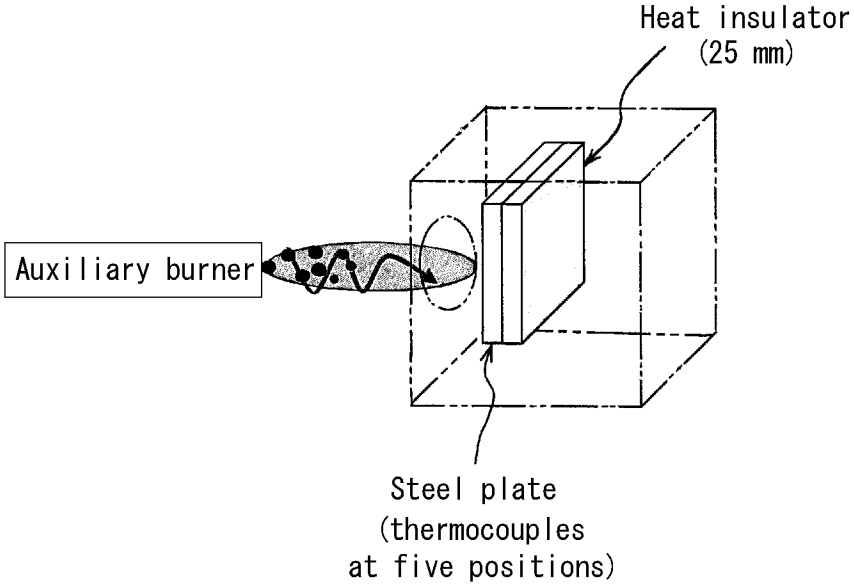

FIGS. 10A and 10B illustrate the outline of a combustion test using an auxiliary burner. Particularly, FIG. 10A illustrates a method of the combustion test, and FIG. 10B illustrates the installation positions of thermocouples with respect to the steel plate used in the combustion test.

The steel plate used for the temperature measurement is SS400, having a size of 500 mm in length, 500 mm in width, and 4 mm in thickness. In order to measure the temperature of the steel plate, K type thermocouples were installed at five positions on the side opposite to the surface irradiated by the burner flame, with one at the center of the plate, one each at the positions 100 mm left and right from the center, and one each at the positions 200 mm left and right from the center. Further, a heat insulator (a fireproof board) having a thickness of 25 mm was installed on the steel plate surface side where the K type thermocouples were installed. The steel plate with this heat insulator was placed in a furnace (furnace temperature: room temperature) provided with an opening for introducing a burner flame on the front surface facing the auxiliary burner. The distance from the tip of the burner to the steel plate was set to be 1.0 m, assuming electric furnace operation.

Burner ignition was taken as the start of the experiment, the outputs of the thermocouples installed on the steel plate were incorporated into a data logger, the heat-up speed of the steel plate from 300° C. to 1000° C. was measured, and the average value, maximum value and minimum value of the heat-up speeds at the five thermocouples arranged in the steel plate width direction were determined. In addition, of the heat-up speeds, [maximum value]−[average value] and [average value]−[minimum value] were determined. The results are presented in Table 3.

Comprehensive evaluations were carried out based on the heat-up speeds of the steel plate according to the following criteria, where "Excellent" and "Good" mean passed and "Poor" means failed. The results are presented in Table 3. It is to be noted that those having an average value of less than 200° C./min in the steel plate width direction of the heat-up speeds of the steel plate basically do not satisfy the performance as a burner.

Excellent: the average value of the heat-up speeds is 200° C./min or more, and [maximum value]−[minimum value] of the heat-up speeds is 100° C./min or less Good: the average value of the heat-up speeds is 200° C./min or more, [maximum value]−[average value] and [average value]−[minimum value] of the heat-up speeds are each 100° C./min or less, and [maximum value]−[minimum value] of the heat-up speeds is more than 100° C./min and 200° C./min or less Poor: One or more of the following conditions (1) to (4) are not satisfied. (1) the average value of the heat-up speeds is 200° C./min or more, (2) [maximum value]−[average value] of the heat-up speeds is 100° C./min or less, (3) [average value]−[minimum value] of the heat-up speeds is 100° C./min or less, and (4) [maximum value]−[minimum value] of the heat-up speeds is 200° C./min or less As can be seen from Table 3, as for Sample No. 1 where the angle $\theta_1$ and the angle $\theta_2$ are both 0°, the average value of heat-up speeds is 187° C./min (maximum value: 228° C./min, minimum value: 152° C./min) which is low, such that it has a problem with heating capacity.

As for Samples No. 5, 7 and 8 where $\theta_1>\theta_2$ not satisfying the condition of the present disclosure, the promoting effect of mixing the gas fuel, the solid fuel and the combustion-supporting gas is insufficient, resulting in a low average value of heat-up speeds of less than 200° C./min. Therefore, similarly to Sample No. 1, Samples No. 5, 7 and 8 have a problem with heating capacity.

On the contrary, because of high heating capability and small variation in heat-up speeds, Samples No. 2 to 4, 6, and 9 to 14, which are Examples of the present disclosure, are capable of heating a wide area stably. Therefore, the scrap can be homogeneously heated, and it is effective against inhomogeneous melting of scrap which becomes a problem in operation.

Also, among Examples of the present disclosure, Samples No. 3, 4 and 9, which correspond to Examples where the angle $\theta_1$ is 20° or more and 45° or less, the angle $\theta_2$ is 45° or more and 65° or less, and $\theta_2-\theta_1$ is 15° or more and 45° or less, each has a high average value of heat-up speeds and a small variation in heat-up speeds. That is, it can be said that these Samples are particularly preferable auxiliary burners.

Further, when comparing Samples No. 3, and 11 to 14 where the angles of the swirl vanes were fixed as $\theta_1$=20° and $\theta_2$=45°, and the values of $Q_1/P_1$ and $Q_2/P_2$ were variously changed, it is known that Samples No. 3, 12 and 13 where the values of $Q_1/P_1$ and $Q_2/P_2$ were set to be 1.0 or more and 1.2 or less have a higher average value of heat-up speeds and a smaller variation in heat-up speeds.

The burner output of 600 Mcal/h in this test was the scale installed in an electric furnace of 60 t/ch, and the test was carried out on the actual machine scale. Therefore, it is obvious that the same effect can be expected also in an actual electric furnace.

TABLE 1

| | | |
|---|---|---|
| Burner output | 600 | Mcal/h |
| Solid fuel blowing amount | 72 | kg/h |
| Flow rate of gas for carrying solid fuel | 5.8 | $Nm^3/h$ |
| Gas fuel flow rate | 6.2 | $Nm^3/h$ |
| Combustion-supporting gas flow rate | 150 | $Nm^3/h$ |

TABLE 2

| Coal type (product name) | MDT |
|---|---|
| Total carbon (mass %) | 81.7 |
| Fixed carbon (mass %) | 76.9 |
| Volatile content (mass %) | 13.4 |
| Ash (mass %) | 9.7 |
| S (mass %) | 0.34 |
| Lower heating value (kcal/kg) | 7511 |
| Particle size d(90) (μm) | 200 |

TABLE 3

| No. | Category | Angle $\theta_2$ of swirl vanes provided in gas fuel injection tube (°) | Angle $\theta_1$ of swirl vanes provided in combustion-supporting gas injection tube (°) | $Q_1/P_1$ (—) | $Q_2/P_2$ (—) | Heat-up speeds of steel plate (300° C.→1000° C.) Average value in steel plate width direction (° C./min) | Heat-up speeds of steel plate (300° C.→1000° C.) Maximum value in steel plate width direction (° C./min) |
|---|---|---|---|---|---|---|---|
| 1 | Comparitive Example | 0 | 0 | 1.1 | 1.1 | 187 | 228 |
| 2 | Example | 20 | 10 | 1.1 | 1.1 | 208 | 259 |
| 3 | Example | 45 | 20 | 1.1 | 1.1 | 248 | 261 |
| 4 | Example | 60 | 45 | 1.1 | 1.1 | 239 | 257 |
| 5 | Comparitive Example | 5 | 20 | 1.1 | 1.1 | 182 | 217 |
| 6 | Example | 75 | 20 | 1.1 | 1.1 | 203 | 234 |
| 7 | Comparitive Example | 30 | 30 | 1.1 | 1.1 | 187 | 218 |
| 8 | Comparitive Example | 50 | 70 | 1.1 | 1.1 | 175 | 209 |
| 9 | Example | 65 | 20 | 1.1 | 1.1 | 246 | 271 |
| 10 | Example | 70 | 50 | 1.1 | 1.1 | 231 | 278 |
| 11 | Example | 45 | 20 | 0.9 | 0.9 | 213 | 256 |
| 12 | Example | 45 | 20 | 1.0 | 1.0 | 228 | 259 |
| 13 | Example | 45 | 20 | 1.2 | 1.2 | 231 | 267 |
| 14 | Example | 45 | 20 | 1.3 | 1.3 | 220 | 281 |

| No. | Category | Heat-up speeds of steel plate (300° C.→1000° C.) Minimum value in steel plate width direction (° C./min) | Variation in heat-up speeds in steel plate width direction: [maximum value] − [average value] (° C./min) | Variation in heat-up speeds in steel plate width direction: [average value] − [minimum value] (° C./min) | Comprehensive evaluation |
|---|---|---|---|---|---|
| 1 | Comparitive Example | 152 | 41 | 35 | Poor |
| 2 | Example | 157 | 51 | 51 | Good |
| 3 | Example | 204 | 13 | 44 | Excellent |
| 4 | Example | 201 | 18 | 38 | Excellent |
| 5 | Comparitive Example | 140 | 35 | 42 | Poor |
| 6 | Example | 124 | 31 | 79 | Good |
| 7 | Comparitive Example | 158 | 31 | 29 | Poor |
| 8 | Comparitive Example | 146 | 34 | 29 | Poor |
| 9 | Example | 194 | 25 | 52 | Excellent |
| 10 | Example | 172 | 47 | 59 | Good |
| 11 | Example | 148 | 43 | 65 | Good |
| 12 | Example | 176 | 31 | 52 | Excellent |

TABLE 3-continued

| | | | | | |
|---|---|---|---|---|---|
| 13 | Example | 181 | 36 | 50 | Excellent |
| 14 | Example | 167 | 61 | 53 | Good |

Example 2

Figure 5:
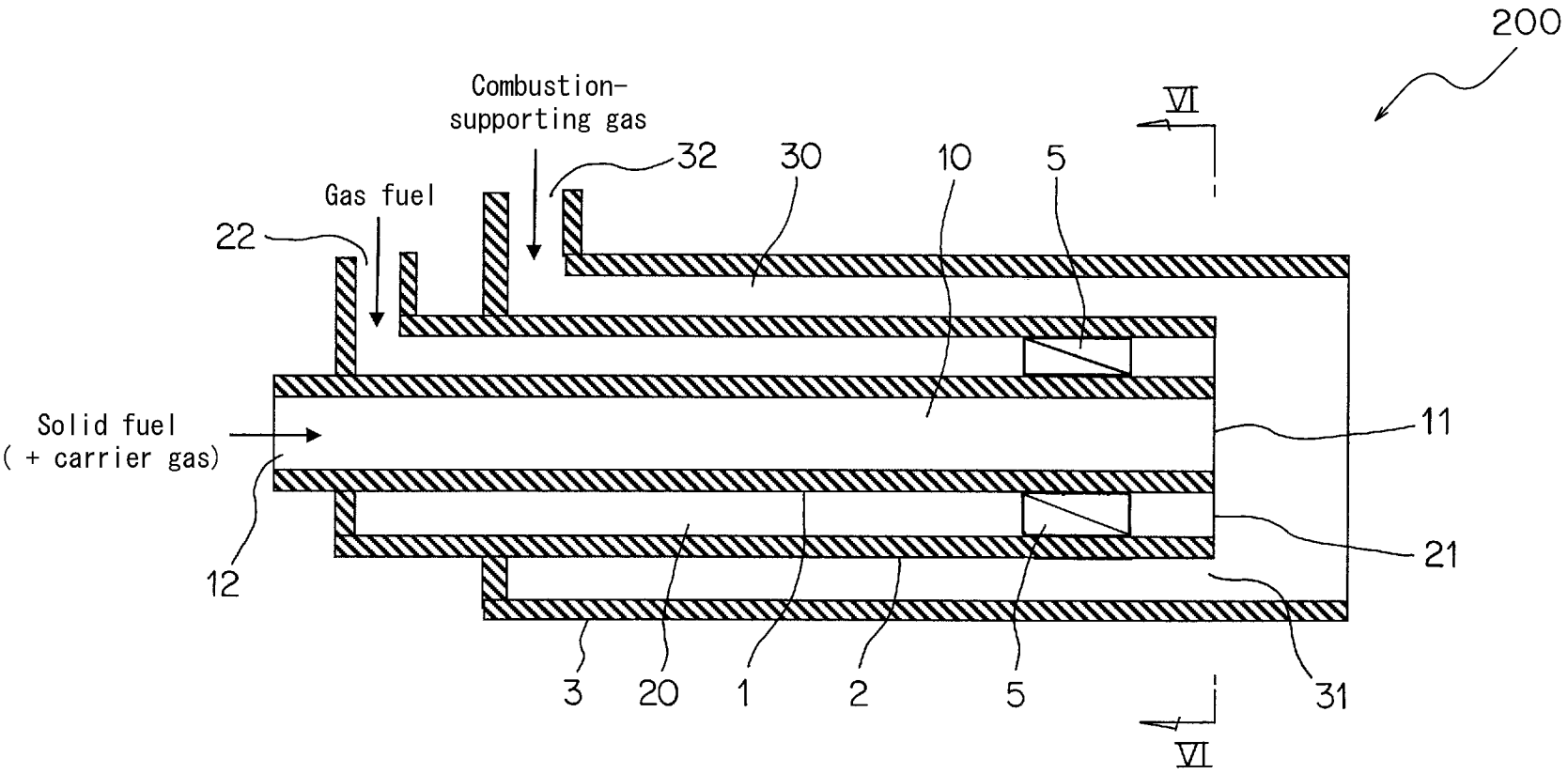
FIG. 5 is a cross-sectional view taken along the burner axis of an auxiliary burner 200 for an electric furnace according to a second embodiment of the present disclosure.
Figure 6:
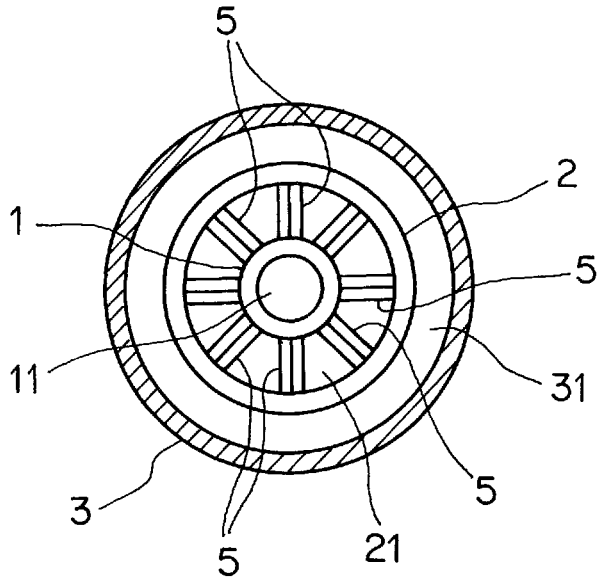
FIG. 6 is a cross-sectional view taken along line VI-VI of FIG. 5.

A steel plate was heated using an auxiliary burner having the structure illustrated in FIGS. 5 to 7, and the temperature thereof was measured. The combustion conditions of the burner (see Table 1), the gas fuel, solid fuel (see Table 2) and the combustion-supporting gas used, the method of the combustion test (see FIGS. 10A and 10B), and the evaluations for the test results were the same as those of [Example 1].

The values of the angle $\theta_2$ of the swirl vanes provided in the gas fuel injection tube and $Q_2/P_2$ at each level were presented in Table 4. Note that, the swirl vanes with an angle of 0° are provided as members to coaxially hold the solid fuel injection tube 1 and the gas fuel injection tube 2, not for the purpose of swirling the gas fuel. Further, at all levels, the number of the swirl vanes was 8, $L_{B2}$ was 40 mm, and $P_2$ was 30 mm.

The results are presented in Table 4. As can be seen from Table 4, Sample No. 1 where $\theta_2$ is 0° is an auxiliary burner substantially the same as Sample No. 1 in Table 3, and it has a low average value of heat-up speeds and a problem with heating capability.

Sample No. 2, where $\theta_2$ is too small, cannot sufficiently swirl the gas fuel, such that sufficient mixing promoting effect cannot be obtained. Therefore, it has a low average value of heat-up speeds of 189° C./min (maximum value: 241° C./min, minimum value: 118° C./min), and similarly to Sample No. 1, has a problem with heating capability.

Sample No. 7, where $\theta_2$ is too large, has a short burner flame due to reduction in the straightness of the burner flame, such that it has an extremely low average value of heat-up speeds of 170° C./min (maximum value: 198° C./min, minimum value: 115° C./min), and has a problem with heating capability.

On the contrary, because of high heating capability and small variation in heat-up speeds, Samples No. 3 to 6, and 8 to 11, which are Examples of the present disclosure, are capable of heating a wide area stably. Therefore, the scrap can be homogeneously heated, and it is effective against inhomogeneous melting of scrap which becomes a problem in operation.

Also, among Examples of the present disclosure, Samples No. 4 and 5, each having the angle $\theta_2$ of the swirl vanes set to be 45° or more and 60° or less, have a particularly high average value of heat-up speeds and a particularly small variation in heat-up speeds (with [maximum value]−[minimum value] of the heat-up speeds being 100° C./min or less), and therefore can be said to be particularly preferable auxiliary burners.

Further, when comparing Samples No. 5, and 8 to 11 where the angle $\theta_2$ of the swirl vanes was fixed equal to 60° and the value of $Q_2/P_2$ was variously changed, it is known that Samples No. 5, 9 and 10 where the value of $Q_2/P_2$ was set to be 1.0 or more and 1.2 or less have a higher average value of heat-up speeds and a smaller variation in heat-up speeds.

TABLE 4

| | | Angle $\theta_2$ of swirl vanes | | Heat-up speeds of steel plate (300° C.→1000° C.) | | |
|---|---|---|---|---|---|---|
| No. | Category | provided in gas fuel injection tube (°) | $Q_2/P_2$ (—) | Average value in steel plate width direction (° C./min) | Maximum value in steel plate width direction (° C./min) | Minimum value in steel plate width direction (° C./min) |
| 1 | Comparative Example | 0 | 1.1 | 187 | 228 | 152 |
| 2 | Comparative Example | 5 | 1.1 | 189 | 241 | 118 |
| 3 | Example | 10 | 1.1 | 210 | 251 | 141 |
| 4 | Example | 45 | 1.1 | 224 | 275 | 198 |
| 5 | Example | 60 | 1.1 | 237 | 286 | 202 |
| 6 | Example | 70 | 1.1 | 215 | 235 | 132 |
| 7 | Comparative Example | 80 | 1.1 | 170 | 198 | 115 |
| 8 | Example | 60 | 0.9 | 209 | 238 | 121 |
| 9 | Example | 60 | 1.0 | 216 | 269 | 196 |
| 10 | Example | 60 | 1.2 | 237 | 286 | 187 |
| 11 | Example | 60 | 1.3 | 222 | 257 | 134 |

| | | Variation in heat-up speeds in steel plate width direction | | |
|---|---|---|---|---|
| No. | Category | [maximum value] − [average value] (° C./min) | [average value] − [minimum value] (° C./min) | Comprehensive evaluation |
| 1 | Comparative Example | 41 | 35 | Poor |
| 2 | Comparative Example | 52 | 71 | Poor |
| 3 | Example | 41 | 69 | Good |
| 4 | Example | 51 | 26 | Excellent |

TABLE 4-continued

| | | | | |
|---|---|---|---|---|
| 5 | Example | 49 | 35 | Excellent |
| 6 | Example | 20 | 83 | Good |
| 7 | Comparative Example | 28 | 55 | Poor |
| 8 | Example | 29 | 88 | Good |
| 9 | Example | 53 | 20 | Excellent |
| 10 | Example | 49 | 50 | Excellent |
| 11 | Example | 35 | 88 | Good |

INDUSTRIAL APPLICABILITY

According to the auxiliary burner of the present disclosure, it is possible to increase and homogenize the heating effect of iron scrap by suitably and efficiently burning the solid fuel along with the gas fuel.

REFERENCE SIGNS LIST

100, 200 Auxiliary burner for electric furnace
1 Solid fuel injection tube
2 Gas fuel injection tube
3 Combustion-supporting gas injection tube
4 Swirl vane (first vane)
5 Swirl vane (second vane)
7 Furnace body
8 Electrode
x Iron scrap
10 Solid fuel flow path (first flow path)
11 Solid fuel discharge port
12 Solid fuel supply port
20 Gas fuel flow path (second flow path)
21 Gas fuel discharge port
22 Gas fuel supply port
30 Combustion-supporting gas flow path (third flow path)
31 Combustion-supporting gas discharge port
32 Combustion-supporting gas supply port
$\theta_1$ Angle formed between swirl vanes 4 and burner axis
$Q_1$ Length of each swirl vane 4 in circumferential direction of third flow path
$P_1$ Installation intervals of swirl vanes 4 in circumferential direction of third flow path
$\theta_2$ Angle formed between swirl vanes 5 and burner axis
$Q_2$ Length of each swirl vane 5 in circumferential direction of second flow path
$P_2$ Installation intervals of swirl vanes 5 in circumferential direction of second flow path

The invention claimed is:

1. An auxiliary burner for an electric furnace for manufacturing molten iron by melting iron scrap, which is attached to the electric furnace and uses a gas fuel and a solid fuel as fuel, comprising:

a solid fuel injection tube defining a first flow path through which the solid fuel passes and configured to inject the solid fuel from a tip of the first flow path;

a gas fuel injection tube arranged around the solid fuel injection tube, defining a second flow path through which the gas fuel passes between the gas fuel injection tube and an outer wall of the solid fuel injection tube, and configured to inject the gas fuel from a tip of the second flow path;

a combustion-supporting gas injection tube arranged around the gas fuel injection tube, defining a third flow path through which a combustion-supporting gas passes between the combustion-supporting gas injection tube and an outer wall of the gas fuel injection tube, and configured to inject the combustion-supporting gas from a tip of the third flow path;

a plurality of first vanes arranged in the third flow path at a predetermined interval in a circumferential direction of the third flow path; and a plurality of second vanes arranged in the second flow path at a predetermined interval in a circumferential direction of the second flow path, wherein the plurality of first vanes form an angle $\theta_1$ with a burner axis and the plurality of second vanes form an angle $\theta_2$ with the burner axis, the angles satisfying a relationship $\theta_1<\theta_2$, and the angle $\theta_1$ is 10° or more and 50° or less, and the angle $\theta_2$ is 20° or more and 75° or less.

2. An auxiliary burner for an electric furnace for manufacturing molten iron by melting iron scrap, which is attached to the electric furnace and uses a gas fuel and a solid fuel as fuel, comprising:

a solid fuel injection tube defining a first flow path through which the solid fuel passes and configured to inject the solid fuel from a tip of the first flow path;

a gas fuel injection tube arranged around the solid fuel injection tube, defining a second flow path through which the gas fuel passes between the gas fuel injection tube and an outer wall of the solid fuel injection tube, and configured to inject the gas fuel from a tip of the second flow path;

a combustion-supporting gas injection tube arranged around the gas fuel injection tube, defining a third flow path through which a combustion-supporting gas passes between the combustion-supporting gas injection tube and an outer wall of the gas fuel injection tube, and configured to inject the combustion-supporting gas from a tip of the third flow path;

a plurality of first vanes arranged in the third flow path at a predetermined interval in a circumferential direction of the third flow path; and a plurality of second vanes arranged in the second flow path at a predetermined interval in a circumferential direction of the second flow path, wherein the plurality of first vanes form an angle 01 with a burner axis and the plurality of second vanes form an angle 02 with the burner axis, the angles satisfying a relationship $\theta_1<\theta_2$, wherein $\theta_2-\theta_1$ is 15° or more and 45° or less.

3. The auxiliary burner for an electric furnace according to claim 1, wherein $\theta_2-\theta_1$ is 15° or more and 45° or less.

4. The auxiliary burner for an electric furnace according to claim 1, wherein when each of the first vanes has a length $Q_1$ in the circumferential direction of the third flow path and the plurality of first vanes have an installation interval $P_1$ in the circumferential direction of the third flow path, $Q_1/P_1$ is 1.0 or more and 1.2 or less; and when each of the second vanes has a length $Q_2$ in the circumferential direction of the second flow path and the plurality of second vanes have an installation interval $P_2$ in the circumferential direction of the second flow path, $Q_2/P_2$ is 1.0 or more and 1.2 or less.

5. The auxiliary burner for an electric furnace according to claim 2, wherein when each of the first vanes has a length $Q_1$ in the circumferential direction of the third flow path and the plurality of first vanes have an installation interval $P_1$ in the circumferential direction of the third flow path, $Q_1/P_1$ is 1.0 or more and 1.2 or less; and when each of the second vanes has a length $Q_2$ in the circumferential direction of the second flow path and the plurality of second vanes have an installation interval $P_2$ in the circumferential direction of the second flow path, $Q_2/P_2$ is 1.0 or more and 1.2 or less.

6. The auxiliary burner for an electric furnace according to claim 3, wherein when each of the first vanes has a length $Q_1$ in the circumferential direction of the third flow path and the plurality of first vanes have an installation interval $P_1$ in the circumferential direction of the third flow path, $Q_1/P_1$ is 1.0 or more and 1.2 or less; and when each of the second vanes has a length $Q_2$ in the circumferential direction of the second flow path and the plurality of second vanes have an installation interval $P_2$ in the circumferential direction of the second flow path, $Q_2/P_2$ is 1.0 or more and 1.2 or less.

7. An auxiliary burner for an electric furnace for manufacturing molten iron by melting iron scrap, which is attached to the electric furnace and uses a gas fuel and a solid fuel as fuel, comprising:

a solid fuel injection tube defining a first flow path through which the solid fuel passes and configured to inject the solid fuel from a tip of the first flow path;

a gas fuel injection tube arranged around the solid fuel injection tube, defining a second flow path through which the gas fuel passes between the gas fuel injection tube and an outer wall of the solid fuel injection tube, and configured to inject the gas fuel from a tip of the second flow path;

a combustion-supporting gas injection tube arranged around the gas fuel injection tube, defining a third flow path through which a combustion-supporting gas passes between the combustion-supporting gas injection tube and an outer wall of the gas fuel injection tube, and configured to inject the combustion-supporting gas from a tip of the third flow path;

a plurality of first vanes arranged in the third flow path at a predetermined interval in a circumferential direction of the third flow path; and a plurality of second vanes arranged in the second flow path at a predetermined interval in a circumferential direction of the second flow path, wherein the plurality of first vanes form an angle $\theta_1$ with a burner axis and the plurality of second vanes form an angle $\theta_2$ with the burner axis, the angles satisfying a relationship $\theta_1<\theta_2$, wherein the angle $\theta_1$ is 0°, and the angle $\theta_2$ is 10° or more and 70° or less.

8. The auxiliary burner for an electric furnace according to claim 7, wherein the angle $\theta_2$ is 45° or more and 60° or less.

9. The auxiliary burner for an electric furnace according to claim 7, wherein when each of the second vanes has a length $Q_2$ in the circumferential direction of the second flow path and the plurality of second vanes have an installation interval $P_2$ in the circumferential direction of the second flow path, $Q_2/P_2$ is 1.0 or more and 1.2 or less.

10. The auxiliary burner for an electric furnace according to claim 8, wherein when each of the second vanes has a length $Q_2$ in the circumferential direction of the second flow path and the plurality of second vanes have an installation interval $P_2$ in the circumferential direction of the second flow path, $Q_2/P_2$ is 1.0 or more and 1.2 or less.

* * * * *